United States Patent [19]

Ulan

[11] Patent Number: 5,040,800

[45] Date of Patent: Aug. 20, 1991

[54] VERTICAL PERSPECTIVE GAME APPARATUS

[76] Inventor: Joel Ulan, 152 W. 76th St., New York, N.Y. 10023

[21] Appl. No.: 601,929

[22] Filed: Oct. 22, 1990

[51] Int. Cl.[5] ..... A63F 3/02

[52] U.S. Cl. ..... 273/239; 273/260; 273/282; 273/288; D21/24; D21/52

[58] Field of Search ..... 273/282, 282 B, 282 A, 273/282 C, 260, 239, 287, 241, 288; D21/24, 25, 14, 34, 51, 52

[56] References Cited

U.S. PATENT DOCUMENTS

| | | | |
|---|---|---|---|
| 413,026 | 10/1889 | Catlin | 273/282 |
| 798,170 | 8/1905 | Cross | 273/282 |
| 4,055,345 | 10/1977 | Havlik | 273/282 C |

FOREIGN PATENT DOCUMENTS

| | | | |
|---|---|---|---|
| 1134934 | 12/1956 | France | 273/239 |
| 829342 | 3/1960 | United Kingdom | 273/239 |

*Primary Examiner*—Benjamin Layno
*Attorney, Agent, or Firm*—Nathaniel Altman

[57] ABSTRACT

Apparatus for a board game, wherein playing pieces are moved to and from designated positions on the game board's surface, has a vertically disposed planar game board with the playing surface area represented in perspective, giving the effect of depth and a three-dimensional appearance. Playing pieces, releasably held in their assigned positions by magnets or projections, are angularly truncated at their bases so that each piece when in place extends outwardly and upwardly from the playing surface at a predetermined angle.

14 Claims, 2 Drawing Sheets

FIG. 3
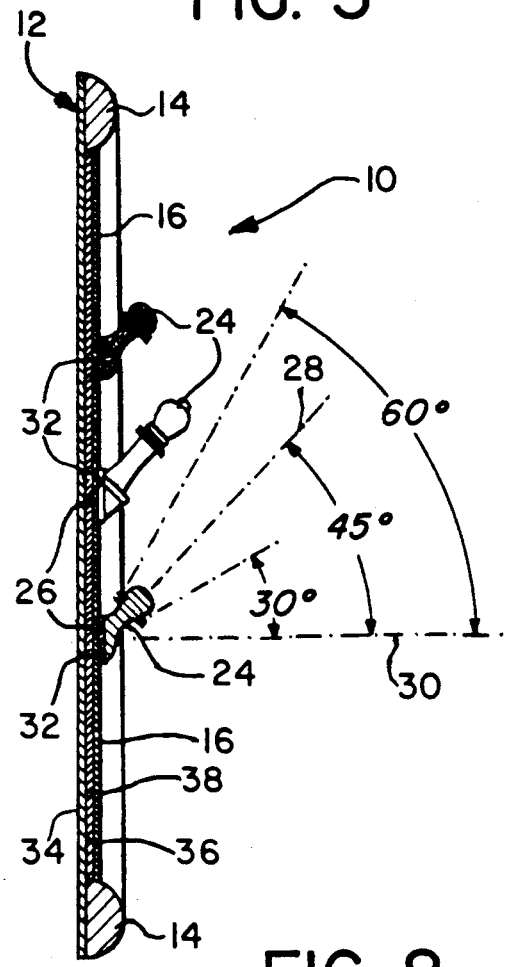
FIG. 4
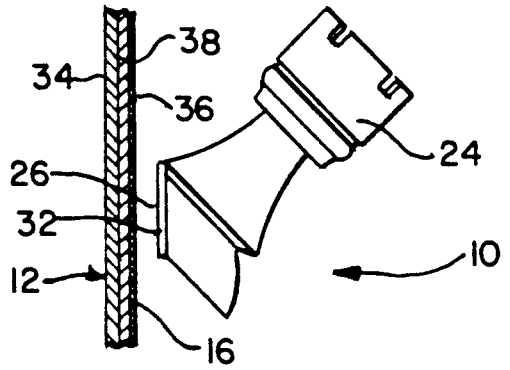
FIG. 5
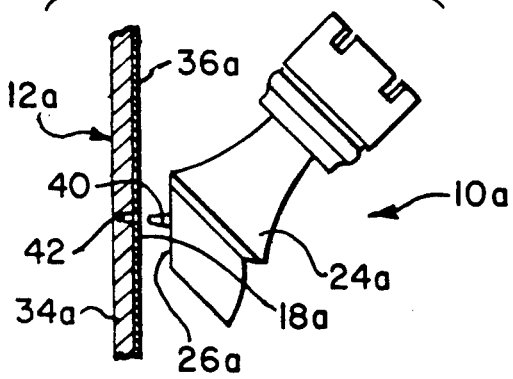
FIG. 8
FIG. 7
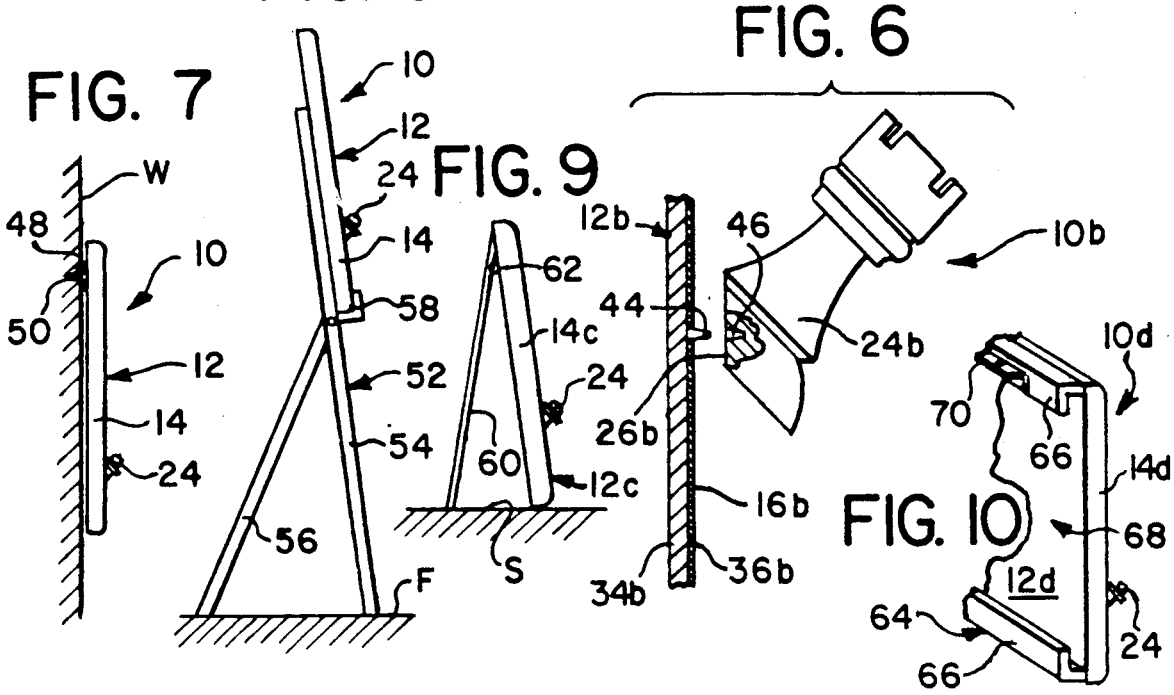
FIG. 9
FIG. 6
FIG. 10

VERTICAL PERSPECTIVE GAME APPARATUS

BACKGROUND OF THE INVENTION

This invention relates to apparatus for those board games on which playing pieces are moved to and from designated locations on the board's playing surface.

It is the principal object of this invention to provide ornamental, attractive, artistic highly visible game apparatus for mounting vertically on a wall or support, with which the game may be played or displayed for teaching, problem-solving or for following the progress of a match.

While the descriptions and drawings in this specification all illustrate the concepts of this invention as applied to the game of chess, it is evident that the elements of this invention may be incorporated into any board game that involves the movement of playing pieces to and from designated positions on the playing surface of the game board. Such board games may include, for example: backgammon, checkers, Monopoly (Reg. TM), Scrabble (Reg. TM), Parcheesi (Reg. TM), as well as innumerable others.

SUMMARY OF THE INVENTION

The game apparatus of this invention has a planar, vertically disposed game board, on the surface of which the game playing area is represented in perspective view so that the visual effect of depth and three-dimensional appearance is achieved. The board may be framed to enhance the effect of the game apparatus as an art work. Game-playing pieces, to be placed at designated but changing locations on the playing area of the board, are formed with their bases angularly truncated; when so placed and held on the board by magnets or other means, each playing piece projects outwardly and upwardly from the board's surface at a predetermined angle, resulting in a game display of high visibility and of attractively ornamental three-dimensional appearance. Provision is made for hanging the game apparatus on a wall or supporting it in substantially vertical position, and for space-saving storage of a conventional game board, playing pieces or other game paraphenalia in space arranged behind the vertically disposed game board.

Full details of the preferred embodiments of this invention will be disclosed in connection with the accompanying illustrative drawings, wherein:

SHORT FIGURE DESCRIPTION OF DRAWINGS

FIG. 3 is a sectional view taken along line 3—3 of FIG. 1;

FIG. 4 is a side elevational exploded view of a typical chess playing piece with a portion of the game board of FIG. 1 shown in section;

FIGS. 5 and 6 are views similar to FIG. 4, with each showing another embodiment of the game apparatus of this invention;

FIG. 7 is a side elevational view of the game apparatus hanging vertically on a wall;

FIG. 8 is a side elevational view of the game apparatus supported in a substantially vertical position on an easel:

FIG. 9 is a side elevational view of the game apparatus supported in a substantially vertical position by a leg hingedly connected to the game board; and FIG. 10 is a partial side perspective view of another embodiment of the game apparatus of this invention.

DESCRIPTION OF THE PREFERRED EMBODIMENTS

Figure 2:
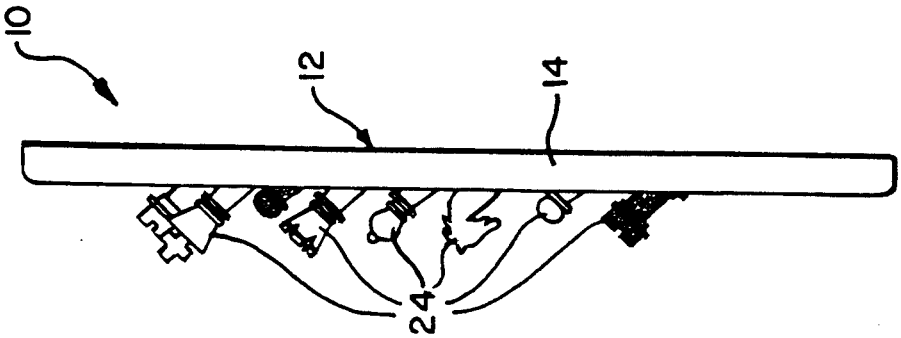
FIG. 2 is a right side elevational view of the apparatus of FIG. 1.

FIGS. 1–4 illustrate chess game apparatus generally designated 10 in its normal vertical position. Chess board 12 is in the form of a planar rectangle surrounded by optional frame 14. Chess playing surface 16 of board 12 has the conventional sixty-four alternating light and dark playing position 18 which, however, are not square and which diminish in size from lowest row 20, which appears to be the nearest, to topmost row 22, which appears to be the furthest away from a viewer.

Figure 1:
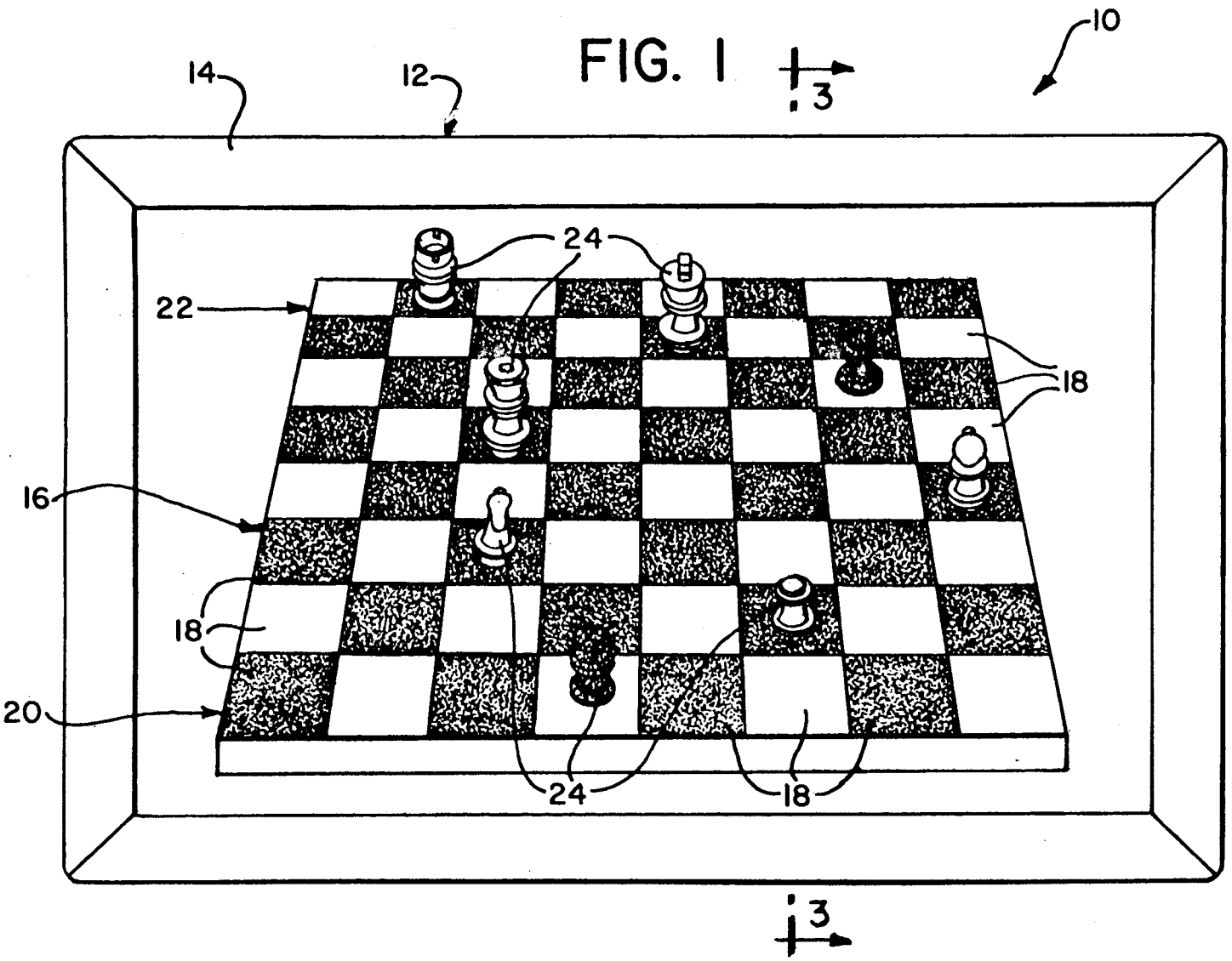
FIG. 1 is a front elevational view of chess game apparatus in accordance with this invention.

In FIGS. 1–3, an assortment of typical chess playing pieces 24 are shown, for illustrative purposes, on playing positions 18 randomly and not in accordance with any actual game situation. Chess pieces 24 are conventional in size and shape but rest on vertically disposed playing surface 16 in upwardly directed angular relationship thereto. As best seen in FIGS. 3 and 4, the base 26 of each chess piece 24 is truncated at an angle in the range of 30° to 60° with respect to the normally vertical axis of each piece 24, the preferred angle being 45°. When base 26 of a piece 24 is placed on playing surface 16, therefore, the piece's principal axis 28 will be, as shown in FIG. 3, at 45° with respect to the horizontal line 30 perpendicular to playing surface 16.

Base 26 of each playing piece 24, in the preferred embodiment of FIGS. 3–4, is provided with a flat magnet 32 for holding the piece 24 on a selective designated position 18 on playing surface 16; board 12 comprises a back support layer 34, a front surface layer 36 on which playing surface 16 is depicted, and a magnetically susceptible layer 38 sandwiched therebetween, for holding magnets 32, and therefore playing pieces 24, in place.

In this way, substantially vertical board 12 holds playing pieces 24 releasably secure on their appropriate positions 18, and, as seen in FIG. 1, the combination of perspectively formed playing surface 16 and angularly disposed playing pieces 24 creates an attractively decorative three-dimensional effect and high visibility in game apparatus 10, which may be further enhanced by the selective use of desirable color combinations for light and dark positions 18, for light and dark playing pieces 24 for the non-playing surface of board 12, and for optional frame 14.

The size of game apparatus 10 may vary from that of a small wall-hanging for the home to that of a large auditorium display, with board 12 and pieces 24 porportioned for home play, for instructional viewing, illustrative problem display, or for charting the progress of a match to an assembled audience.

Alternate methods of releasably securing chess pieces to chessboard positions are shown in FIGS. 5 and 6. Specifically, in FIG. 5, chess piece **24*a* is provided with pin 40 projecting perpendicularly from base 26*a*, and board 12*a* has corresponding and complementary opening 42 to accommodate pin 40. It is obvious that in this embodiment, each chess piece 24*a* in the set has an identical pin 40, and every playing position 42 has an opening 42. In FIG. 6, pins and openings are reversed, i.e., board 12*b* has a projection 44 at each playing position 18*b* to accept thereon the opening 46 in any playing piece 24*b***.

FIGS. 7–9 describe different ways to support any of the chess boards 12, 12*a* or 12*b* in substantially vertical orientation. In FIG. 7, game apparatus 10 (with one illustrative playing piece shown) is suspended by clip 48 held by screw or nail 50 projecting from wall W. It is apparent that any conventional means for hanging a picture may be substituted. An easel 52 supports game apparatus 10 in FIG. 8, and comprises main support 54, hinged rear leg 56 and ledged support shelf 58 on which apparatus 10 rests in substantially vertical position with respect to floor F. Game board 12*c* in FIG. 9 is held upright on surface S by support leg 60, hinged directly to board 12*c* at 62.

The embodiment of FIG. 10 illustrates game board 12*d* very much like the chess boards described above, but supplemented with holding mechanism 64, which is mounted on game board 12*d*'s rear face and comprises two L-shaped guides 66 facing each other attached to the top and bottom of board 12*d*'s rear surface. A storage space 68 is thus created within guides 66 to be used as a space saver for storing game equipment. With board 12*d* positioned on a wall (not shown) and hung in place by means of support cleat 70, space 68 behind board 12*d* may be proportioned to accommodate, for example, a conventional chess board, a container of chess pieces or other game paraphenalia as well.

Various embodiments of this invention have been fully described and illustrated; other modifications and substitutions are within the sphere of the invention's concepts, which are limited only by the scope of the appended claims.

What is claim is:

1. Apparatus for a game wherein playing pieces are moved to and from designated locations on a game board, which comprises:

a planar game board to be oriented in a substantially vertical position, said game board having on its front surface a perspective depiction of the game's playing field to create the illusion of depth and thereby to give said board surface a three-dimensional appearance;

game playing pieces, each of said pieces having a bottom surface at an angle with respect to the vertical axis of each piece, whereby each of said playing pieces, when placed on said game board's playing field, is positioned in angular relationship to the surface of said game board; and means for releasably holding each of said playing pieces at designated locations on said game board's playing field.

2. Game apparatus as defined by claim 1, further comprising means for supporting said game board in a substantially vertical position.

3. Game apparatus as defined by claim 2, wherein said means for supporting said game board is conventional picturehanging means.

4. Game apparatus as defined by claim 2, wherein said means for supporting said game board is an easel.

5. Game apparatus as defined by claim 2, wherein said means for supporting said game board is at least one support leg hingedly mounted on the rear portion of said game board.

6. Game apparatus as defined by claim 1, wherein said means for releasably holding said playing pieces is magnetic.

7. Game apparatus as defined by claim 6, wherein said magnetic means comprises magnetically susceptible means positioned under the surface of said playing field cooperating with magnets mounted on said angled bottom of each said playing piece.

8. Game apparatus as defined by claim 1, wherein said means for releasably holding said playing pieces comprises a projection extending from said angled bottom surface of each said playing piece and each designated location on said game board's playing surface having an opening complementary in size and shape to each said playing piece projection.

9. Game apparatus as defined by claim 1, wherein said means for releasably holding said playing pieces comprises a projection extending from each designated location on said playing field surface and each said angled bottom surface of each said playing piece having an opening therein complementary in size and shape to each said playing field projection.

10. Game apparatus as defined by claim 1, wherein said angle of the bottom surface of each said game playing piece is selected from the range of 30°–60° upward from a substantially horizontal line, said line being perpendicular to said playing surface of said game board.

11. Game apparatus as defined by claim 10, wherein said angle of the bottom surface of each said playing piece is preferably 45°.

12. Game apparatus as defined in claim 1, wherein the game is chess.

13. Game apparatus as defined in claim 1, wherein said planar game board's periphery is encompassed by a frame.

14. Game apparatus as defined by claim 1, further comprising means for providing storage space for game equipment and paraphenalia, said means being mounted on the rear of said planar game board.

* * * * *